US007425688B2

(12) United States Patent
Loesch et al.

(10) Patent No.: US 7,425,688 B2
(45) Date of Patent: Sep. 16, 2008

(54) HEATING ASSEMBLY FOR A TUMBLE DRYER

(75) Inventors: Andreas Loesch, Annweiler (DE); Ralf Frohn, Erlenbach (DE); Jerome Grunewald, Silz (DE); Jens Koehne, Kandel (DE)

(73) Assignee: DBK David + Baader GmbH, Kandel (DE)

( * ) Notice: Subject to any disclaimer, the term of this patent is extended or adjusted under 35 U.S.C. 154(b) by 341 days.

(21) Appl. No.: 11/123,888

(22) Filed: May 6, 2005

(65) Prior Publication Data

US 2005/0252033 A1 Nov. 17, 2005

(30) Foreign Application Priority Data

May 7, 2004 (EP) ..... 04011008.2

(51) Int. Cl.
*A21B 1/22* (2006.01)
*F26B 11/02* (2006.01)

(52) U.S. Cl. ..... 219/400; 219/537; 219/525; 34/131; 34/132; 34/134; 34/242; 34/604; 34/610; 34/549; 34/562; 34/486; 34/487; 34/553; 34/554; 34/493; 34/491; 34/603; 34/543

(58) Field of Classification Search ..... 219/400, 219/537, 525; 34/131–132, 134, 242, 604, 34/610, 549, 562, 486–487, 553–554, 493, 34/491, 603, 543
See application file for complete search history.

(56) References Cited

U.S. PATENT DOCUMENTS 2,748,496 A 6/1956 Hellyer
2,936,527 A 5/1960 Hutt
3,039,285 A 6/1962 Smith
3,292,769 A 12/1966 Zuppiger
3,293,769 A 12/1966 Graham
3,449,838 A 6/1969 Chancellor
3,545,235 A 12/1970 Menk
3,799,387 A 3/1974 Zenz
3,816,706 A 6/1974 Meywald
3,975,832 A 8/1976 Mori et al.
4,019,023 A 4/1977 Marzonie et al.
4,063,590 A 12/1977 McConnell
4,207,686 A 6/1980 Daily
4,638,573 A 1/1987 Nakamura et al.
4,653,200 A 3/1987 Werner (Continued)

FOREIGN PATENT DOCUMENTS

CH 240775 1/1946

(Continued)

*Primary Examiner*—Shawntina Fuqua
(74) *Attorney, Agent, or Firm*—Michael Best & Friedrich LLP

(57) ABSTRACT

A heating assembly for heating a hot air stream flowing in a flow passage of a tumble dryer. The heating assembly is configured for installation in the flow passage and comprises at least one heating element and at least one temperature sensor. The heating element is arranged such that the hot air stream can flow around it in a passing direction (D). The at least one temperature sensor can detect the temperature of the hot air stream and is arranged such that it projects into a core area of the hot air stream.

24 Claims, 5 Drawing Sheets

U.S. PATENT DOCUMENTS

| | | | | |
|---|---|---|---|---|
| 4,700,495 | A * | 10/1987 | Drews et al. | 34/603 |
| 4,857,707 | A | 8/1989 | Dall | |
| 4,994,654 | A | 2/1991 | St. Louis | |
| 5,134,270 | A | 7/1992 | Bragg et al. | |
| 5,161,314 | A | 11/1992 | Souza | |
| 5,443,541 | A | 8/1995 | St. Louis | |
| 5,560,120 | A | 10/1996 | Swanson et al. | |
| 6,108,940 | A | 8/2000 | St. Louis | |
| 6,519,871 | B2 | 2/2003 | Gardner et al. | |
| 2005/0217138 | A1 | 10/2005 | Kohne et al. | |

FOREIGN PATENT DOCUMENTS

| | | |
|---|---|---|
| DE | 1 585 978 | 11/1969 |
| DE | 2615013 | 10/1977 |
| DE | 3340313 | 5/1985 |
| DE | 34 19 743 | 11/1985 |
| DE | 41 39 588 | 6/1992 |
| DE | 43 27 916 | 2/1994 |
| DE | 198 42 644 | 3/2000 |
| EP | 0 352 499 | 1/1990 |
| EP | 0 344 588 | 3/1993 |
| EP | 0 576 825 | 10/1996 |
| GB | 1482520 | 8/1977 |
| JP | 55070420 | 5/1980 |
| JP | 56130192 | 10/1981 |
| JP | 0029788 | 8/1987 |
| JP | 2000317200 | 11/2000 |
| WO | 2004/042132 | 5/2004 |

* cited by examiner

HEATING ASSEMBLY FOR A TUMBLE DRYER

FIELD OF THE INVENTION

The present invention relates to a heating assembly for heating a hot air stream flowing in a flow passage of a tumble dryer, said heating assembly being configured for installation in said flow passage and comprising at least one heating element and at least one temperature sensor.

BACKGROUND OF THE INVENTION

Tumble dryers normally operate such that wet laundry which is contained in a rotatable drum in the interior of the tumble dryer, is dried by a hot air stream. The hot air stream is conducted from an air supply means through the flow passage, which normally extends between the drum and a rear wall of the tumble dryer, into the drum and through the wet laundry. The flow passage has installed therein a heating assembly, which heats the hot air stream by means of at least one heating element. When the tumble dryer is in operation, at least one temperature sensor detects the temperature of the hot air stream. If a predetermined limit temperature is exceeded, the heating element will be switched off by the control unit of the tumble dryer. A temperature control of this type allows the laundry to be dried at a temperature, which is suitable for textiles. In addition, said temperature control is executed for preventing the rear wall of the tumble dryer to be heated to inadmissibly high temperatures which would endanger the operating safety of the tumble dryer.

DE-A-33 40 313 describes a tumble dryer in which a panel heater is arranged in a flow passage. In the panel heater of DE-A-33 40 313, two heating elements and two temperature sensors are located.

In said known heating assemblies, temperature measurement is, however, not precise so that the heating elements may be excessively heated, whereby the maximum admissible temperature for gentle drying may be exceeded and the outer wall of the tumble dryer may be heated to inadmissible temperatures.

BRIEF SUMMARY OF THE INVENTION

In view of this problem, it is the object of the present invention to provide a heating assembly, which allows execution of a more precise temperature control.

According to the present invention, this object is achieved in that the heating element is arranged such that the hot air stream can flow around it in a flow-through or passing direction, and in that the at least one temperature sensor, through which the temperature of the hot air stream can be detected, is arranged such that it projects into a core area of the hot air stream.

This solution is structurally simple and allows a more precise temperature control based on a more exact temperature determination of the hot air stream.

When the tumble dryer is in operation, the core area in the interior of the hot air stream is heated to a higher temperature than the outer boundary area, which is cooled down more rapidly e.g. by the cold wall of the flow passage and/or which is only in indirect flow contact with the heating element. It follows that the temperature of the hot air stream, which, until now, has only been measured in the boundary area, was not the maximum temperature that is relevant for performing temperature control, and it was not representative of the maximum temperature of the hot air stream. On the basis of the solution according to the present invention, the determination of the maximum temperature becomes so reliable that the admissible limit temperature of the hot air stream will no longer be exceeded. It follows that it neither happens that the textiles to be dried are exposed to excessively high temperatures, which may cause damage, nor that the outer wall of the tumble dryer heats up to temperatures which are higher than the admissible ones.

An excessively high temperature of the hot air stream may e.g. also originate from faulty overheating of the heating element caused by a short circuit. By the solution according to the present invention, overheating of the heating element can be detected more rapidly because the temperature of the core flow will immediately reach the temperature of the overheated heating element.

The heating assembly according to the present invention can be further developed by various, independent embodiments, each of which is advantageous. These embodiments and the respective advantages entailed thereby will be briefly discussed in the following.

According to an advantageous embodiment, a deflection surface, which projects into the hot air stream and deflects said hot air stream from a passing direction to a flow-out or discharge direction, can be oriented at an angle relative to the passing direction which is smaller than the angle defined between the passing direction and the discharge direction. The discharge direction may lead into the laundry drum in an advantageous manner. This has the advantage that separate deflection means located downstream of the heating assembly can be dispensed with, and that a homogeneous hot air stream will be generated in the discharge direction. In order to make the structural design of the heating assembly as simple as possible, the at least one temperature sensor can additionally be arranged on the deflection surface. Furthermore, the deflection surface can project into the core area of the hot air stream.

According to an advantageous further development, the at least one temperature sensor can be implemented as a thermostat by which the supply of energy to the at least one heating element can be controlled in a temperature-dependent manner. This has the effect that the at least one heating element will be switched off by the thermostat, if the admissible limit temperature is exceeded. Additional control lines leading to the control unit of the tumble dryer are therefore not necessary, whereby the cost of material of the heating assembly will be reduced. Furthermore, the heating assembly is thus implemented as a self-monitoring modular unit, which, when the tumble dryer is in operation, only has to be supplied with energy.

In the interior of the tumble dryer, in the area between the rear wall and the laundry drum, only little installation space is available for the flow passage and the heating assembly installed therein. In order to design the heating assembly with the smallest possible height, the at least one temperature sensor can be accommodated in a recess on the side facing away from the hot air stream in accordance with and advantageous embodiment. Furthermore, the recess can be defined by the deflection surface, whereby the heating assembly will be provided with a simple structural design. In addition, the recess can be implemented to vault into the flow passage in the installed condition.

The heating assembly can have, in a cross-section transversely to the rear wall of the tumble dryer, substantially planar outer contours on the side facing away from the hot air stream so that, when the heating assembly has been mounted, a prescribed minimum distance from the rear wall of the tumble dryer will be observed everywhere. Furthermore, the at least one temperature sensor can be arranged in the recess such that, when the rear wall of the tumble dryer is open, it is accessible from outside, at least from its back, so as to allow easy access to the temperature sensors for the purpose of assembly or maintenance. In addition, the deflection means can be produced by a deep-drawing process in an advantageous embodiment. This has the advantage that deep-drawn components can be produced in large-scale manufacture at a reasonable price, and that the deflection means, which can define the recess on the side facing away from the hot air stream, is particularly suitable for this purpose. Furthermore, the deflection means and the support element can be implemented as an integral component so as to reduce the production costs of the heating assembly according to the present invention.

According to an advantageous embodiment, the heating assembly can be provided with at least one flow guide surface on the flow-in side, said at least one flow guide surface being oriented in the flow-in direction on the flow-in side and in the passing direction on the passing side. This has the advantage that a hot air stream, which impinges on the heating assembly at an oblique angle, will be deflected to the optimum passing direction for heating the hot air stream, whereby effective heating of the hot air stream is guaranteed.

For allowing the heating assembly to be installed in and/or removed from the tumble dryer rapidly and easily, the heating assembly may comprise at least one connector by means of which the heating assembly can be electrically connected to a source of energy and/or a control unit. The connector may be a standardized connector, which, being a reasonably priced bought-in part, will reduce the production costs of the heating assembly. Furthermore, the connector can be provided on a cranked flange portion of the support element, said cranked flange portion being adapted to be arranged outside of the flow passage. This allows the connector to be arranged outside of the installation space critical area between the flow passage and the rear wall of the tumble dryer, without increasing the thickness of the heating assembly. In addition, the cranked flange portion of the support element can be provided with reinforcing means, whereby the connector arranged on the flange portion will be supported in a direction of insertion in which a mating plug can be inserted in the connector.

In accordance with a further advantageous embodiment, the heating assembly can be provided with a sealing means with the aid of which the heating assembly can be attached to the flow passage of the tumble dryer in a gas-tight manner. This has the advantage that the hot air stream cannot escape from the flow passage and is conducted into the laundry drum without loss. Furthermore, the heating assembly can be provided with at least one sealed opening through which at least one connecting line of the at least one heating element extends. This has the advantage that, in the installed condition, the connecting lines of the at least one heating element are conducted into the interior of the flow passage in a gas-tight manner and that an escape of part of the hot air stream from the flow passage is prevented.

In order to be able to install the heating assembly in the tumble dryer easily and in order to reduce the assembly time, which is necessary for this purpose, the heating assembly can be implemented such that it can be installed in the flow passage in the form of a preassembled integral component.

In order to reduce the dead time occurring when the heating assembly is switched on and/or off until heating up or cooling down is effected, the at least one heating element may be provided with an electric heating coil. The reaction time of heating coils is markedly shorter than that of e.g. tubular heaters, which, due to the larger mass, are comparatively slow. According to an advantageous further development, the heating coil can additionally be attached to a support body. This has the advantage that a burnt-out heating coil will still be held on the support body and thus be prevented from falling onto other heating coils whereby an electric short circuit would be caused. A method and a device for producing such a heating element is described in DE 26 15 013 C3.

In order to detect overheating of the heating elements within the shortest possible time in the case of a short circuit, an advantageous embodiment can be so conceived that the at least one temperature sensor is arranged downstream of the heating elements in the area of the hot air stream that is located closer to the supply side of said heating elements.

Furthermore, the at least one temperature sensor can be arranged downstream of the heating element halves located on the supply side so that overheating of the short-circuited heating elements can be detected even more rapidly. In addition, the at least one temperature sensor can be arranged at a position which is substantially located on a streakline extending on the supply side of the heating elements. The streakline is here the locus curve of all particles, which pass the heating elements on the supply side in the course of time. The temperature sensor therefore is arranged in an area, which, in the passing direction, overlaps the area around the supply side of the heating elements.

The present invention relates, in addition to the above-described heating assembly and its embodiments, also to a tumble dryer used for drying wet laundry by a hot air stream, said tumble dryer being implemented such that it comprises an air supply means and a flow passage through which the hot air stream can flow. For heating the hot air stream and for preventing nevertheless damage that may be caused to the individual pieces of laundry as well as overheating of the outer wall of the tumble dryer, the tumble dryer comprises a heating assembly according to one of the aforementioned embodiments.

According to an advantageous embodiment, the heating assembly of the tumble dryer according to the present invention may define, at least sectionwise, the flow passage of the tumble dryer. This has the advantage that mounting of the heating assembly will be particularly simple and that the production costs of the tumble dryer according to the present invention will be reduced. Furthermore, the heating assembly can be attached to the flow passage releasably or permanently by means of at least one detent device, whereby the required assembly time of the tumble dryer will be reduced.

The present invention relates, in addition to the above-explained devices and their further developments, also to a method of assembling a tumble dryer with the aid of which a hot air stream used for warming up wet laundry can be heated, when the tumble dryer is in operation. In order to reduce the required assembly time for the tumble dryer, the present invention comprises the steps of preassembling a deflection means, at least one heating element and at least one thermostat so as to obtain a heating assembly, and installing the heating assembly then in a flow passage through which the hot air stream flows when the tumble dryer is in operation.

According to an advantageous further development, the heating assembly can be attached to the flow passage in that it is releasably or permanently locked thereto, so as to simplify the assembly of the tumble dryer.

In the following, the present invention will be explained exemplarily with reference to the drawings enclosed. The various features can be combined independently of one another, as has been explained hereinbefore in connection with the individual advantageous embodiments.

DETAILED DESCRIPTION OF THE INVENTION

Figure 1A:
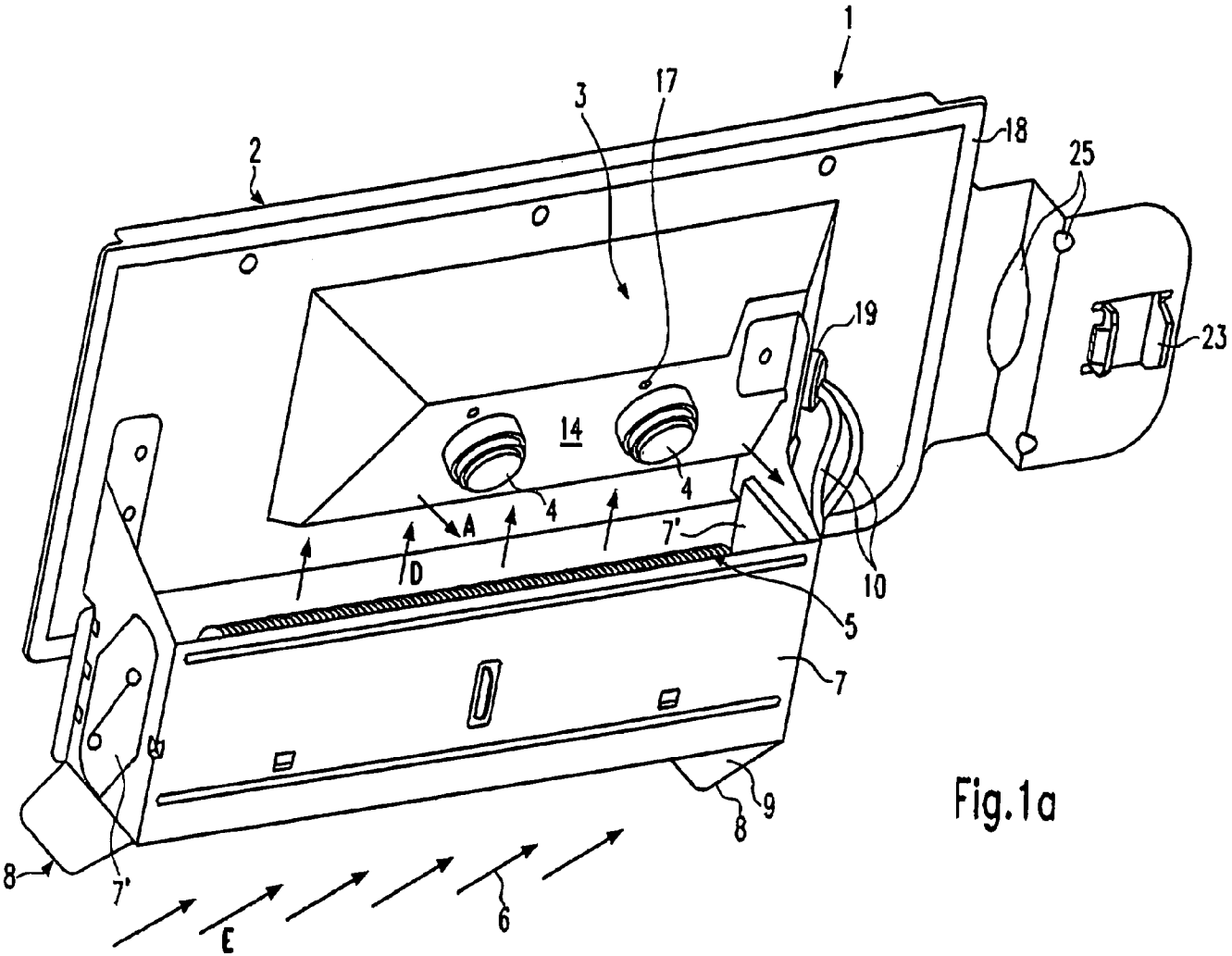
FIG. 1*a* shows a schematic perspective front view of an exemplary embodiment of a heating assembly according to the present invention.

To begin with, the general structural design of a heating assembly according to the present invention will be described with reference to FIG. 1-3 and the exemplary embodiment shown in these figures.

The heating assembly 1 comprises a support element 2 having attached thereto a deflection means 3, two temperature sensors 4 and a plurality of heating elements 5 on the side facing a hot air stream 6 when the heating assembly 1 is in operation.

The heating elements 5 are arranged in a housing frame 7 which is secured to the support element 2 and which has attached thereto a plurality of insulating elements 7'. The housing frame 7 is provided with a plurality of flow guide means 8 which are arranged such that they face the hot air stream 6.

When the heating assembly 1 is in operation, the hot air stream 6 impinges on the flow guide means 8 of the housing frame 7 in a inflow direction E. Flow guide surfaces 9 of the flow guide means 8 are oriented in said inflow direction E on the flow-in side and in a passing direction D on the passing side. The hot air stream 6 is deflected from the flow-in direction E to the passing direction D with the aid of the flow guide surfaces 9 of the flow guide means 8. In the exemplary embodiment of the heating assembly according to the present invention shown in FIG. 1-3, the hot air stream 6 impinges on the heating assembly at an oblique angle. Hence, the flow guide means 8 on the housing frame 7 of FIG. 1-3 are also oriented at an oblique angle relative to said housing frame 7. If the flow-in direction E has a different orientation, the angle at which the flow guide means 8 extend relative to the housing frame 7 is adapted in a suitable manner.

After having been deflected in the passing direction D, the hot air stream 6 impinges on the heating elements 5 and flows through and around these elements. During this process, thermal energy is transmitted from the heating elements 5 to the hot air stream 6 and said hot air stream is heated.

Figure 1B:
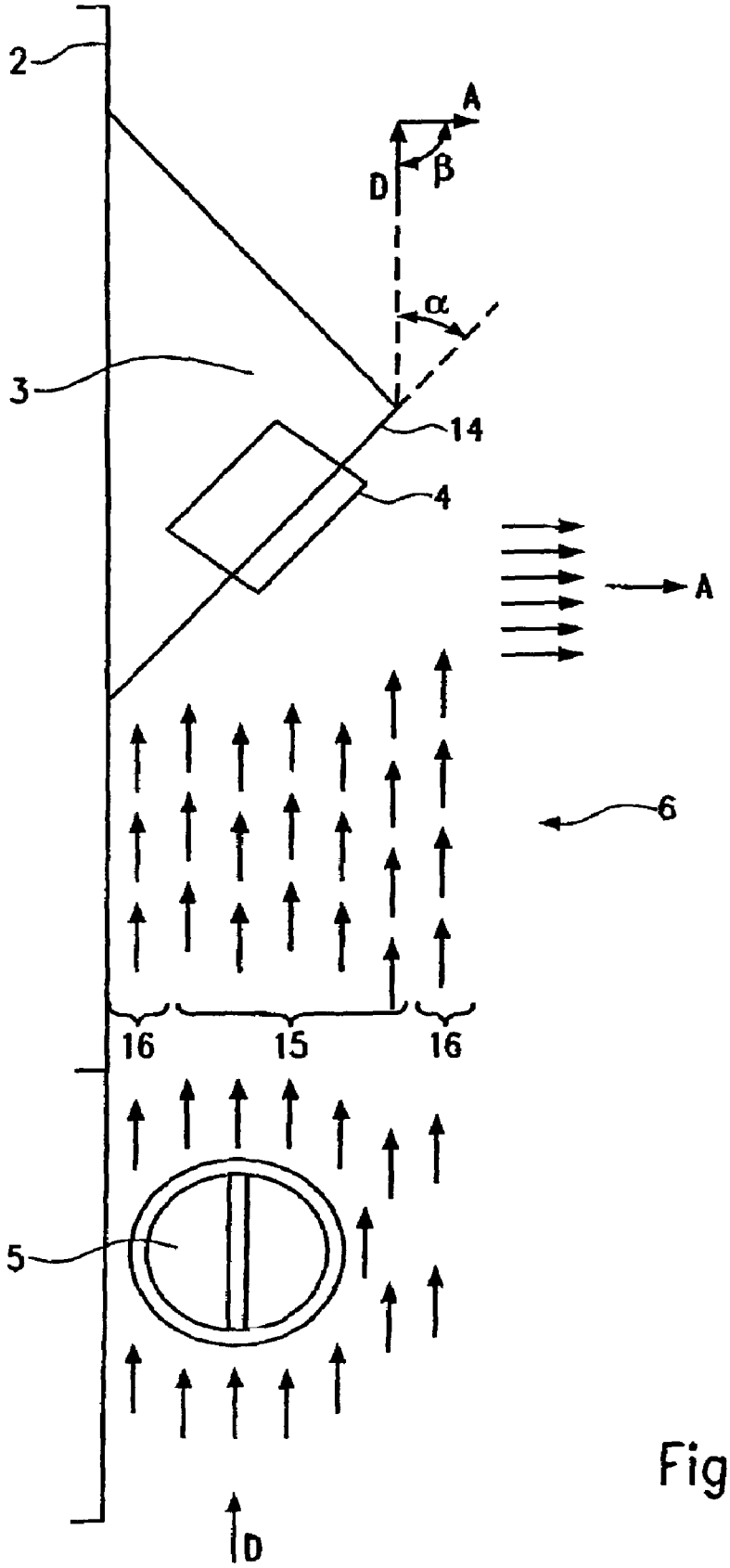
FIG. 1*b* shows a schematic diagram of the hot air stream within the heating assembly according to the present invention shown in FIG. 1*a;*
Figure 2:
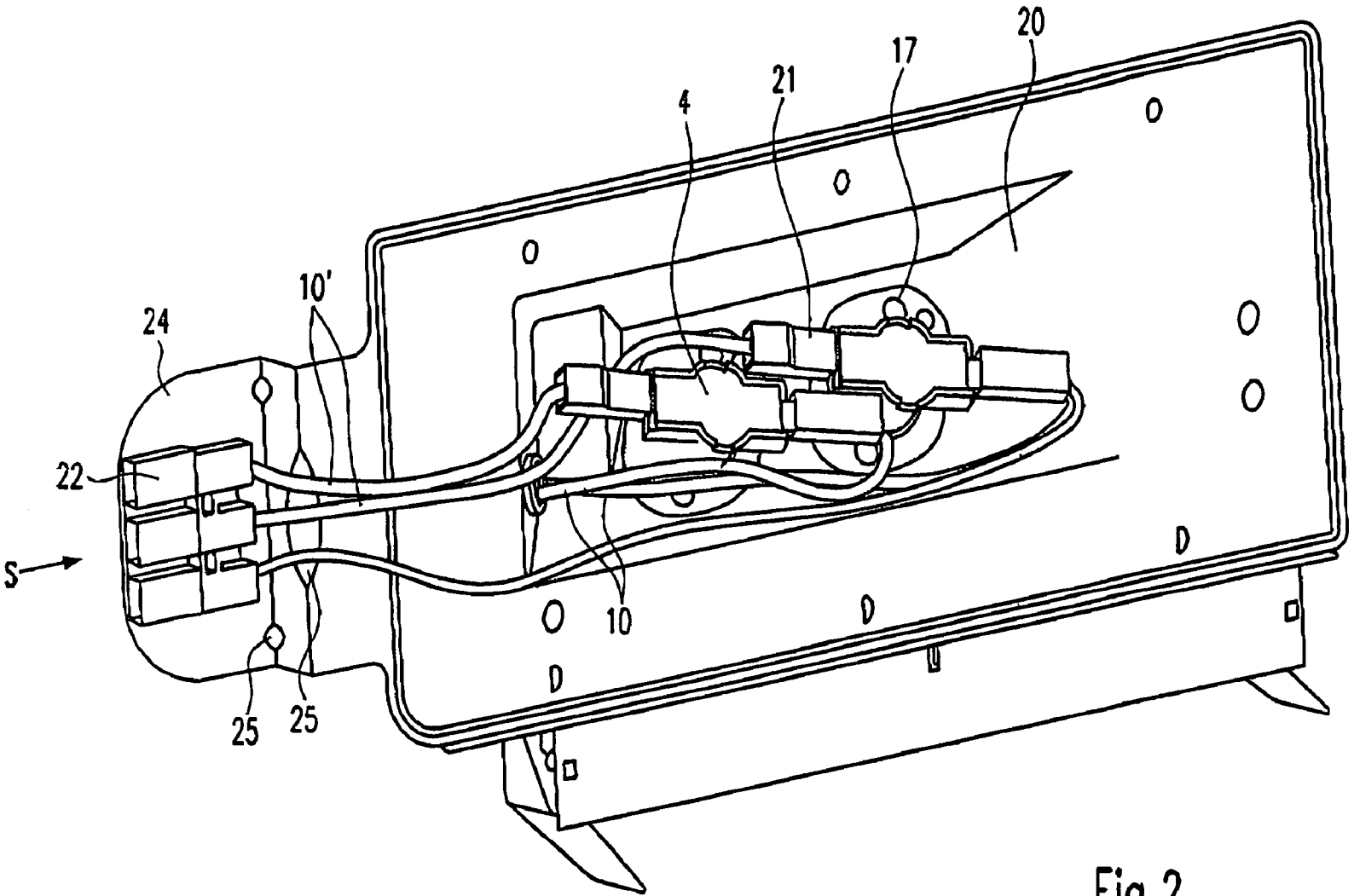
FIG. 2 shows a schematic perspective rear view of the heating assembly shown in FIG. 1*a;*
Figure 3:
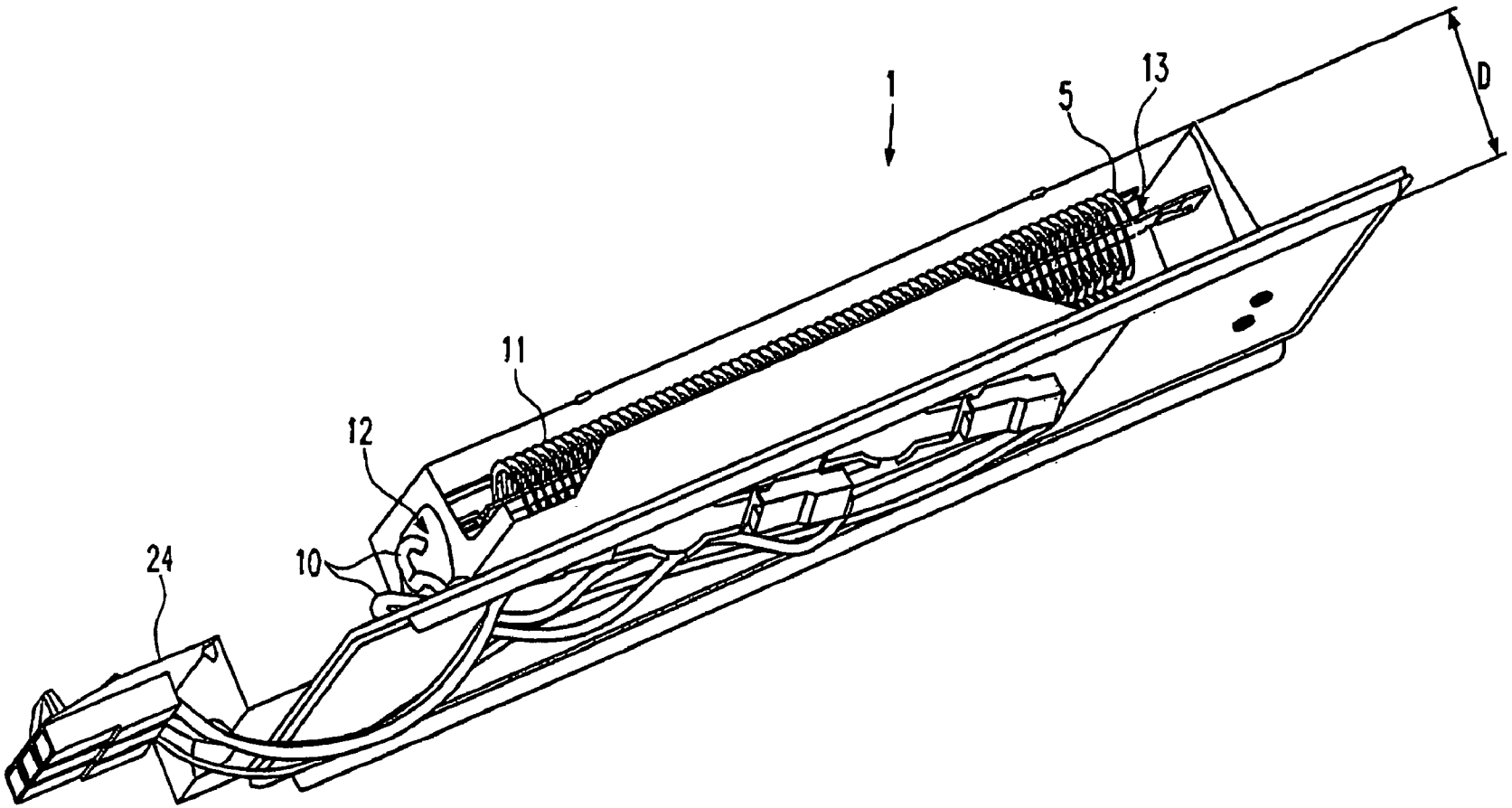
FIG. 3 shows a schematic perspective top view of the heating assembly according to the present invention shown in FIGS. 1 and 2.

In the embodiment shown in FIG. 1-3, the heating elements 5 convert electric energy into thermal energy. For this purpose, electric energy is introduced in the heating elements 5 via connecting lines 10. Each of the heating elements 5 includes a heating coil 11 which, when electric energy flows therethrough, will heat up due to its electric resistance. The embodiment shown in FIG. 1-3 comprises two heating elements 5 which are arranged in parallel. On the supply side 12, each of said heating elements 5 is connected to a connecting line 10 in an electrically conductive manner, e.g. by soldering or by means of a plug connection. On the side located opposite the supply side 12, the heating coils 11 of the two heating elements 5 are interconnected, e.g. by a cable, in an electrically conductive manner and thus connected in series. When the heating assembly 1 is in operation, electric energy will flow from the supply side 12 through the heating coils 11 of the two heating elements 5 and out of said heating elements 5 again at the supply side 12. Due to the electric resistance, the heating coils 11 will heat up and transmit thermal energy to the hot air stream 6 flowing around them.

In order to guarantee a good stability of the heating elements 5 and prevent the heating elements 5 from vibrating or oscillating, the heating coils 11 are wound around support bodies 13. A method and an apparatus for producing such heating elements is described e.g. in DE 26 15 013 C3 Due to the provision of the support body 13, the heating elements 5 have a stable structural design, and it will suffice when the ends thereof rest on the insulating elements 7' which are mounted on the housing frame 7. Furthermore, the support bodies 13 will also support e.g. a burnt-out heating coil 11, which is thus prevented from falling onto the heating coil 11 of the other heating element 5 and causing a short circuit.

The insulating elements 7' are provided with slots (not shown) having the heating elements 5 inserted therein. The heating elements 5 are arranged such that the flat support bodies 13 are oriented in the housing frame 7 parallel to the passing direction D, whereby a particularly low flow resistance of the heating elements 5 will be achieved.

In the embodiment shown in FIG. 1-3, the housing frame 7 is implemented as a punched and edged sheet metal part having the insulating elements 7' attached to the inner side thereof. The insulating elements 7' are made of an electrically and thermally insulating material, such as Mikanit. The housing frame 7 is in this way electrically insulated from the heating elements 5 and thermally isolated from the hot air stream 6. The housing frame 7 is attached to the support element e.g. by means of spot welding. Alternatively, the housing frame 7 and the support element 2 may also be connected by means of rivets, an adhesive or screws.

The hot air stream 6 heated by the heating elements 5 impinges in the passing direction D on a deflection surface 14 of the deflection means 3.

The deflection surface 14 of the deflection means 3 is oriented such that the hot air stream 6, which impinges on said deflection surface 14 in the passing direction D, will be deflected in the direction of a discharge direction A. The angle $\alpha$ defined between the deflection surface 14 and the passing direction D is smaller than the angle defined between the passing direction D and the discharge direction A. In the exemplary embodiment shown in FIG. 1 to 3, the angle $\alpha$ defined between the deflection surface 14 and the passing direction D is essentially half the angle defined between the passing direction D and the discharge direction A. When the heating assembly 1 is in operation, the drum of the tumble dryer will be located in the discharge direction A in an advantageous manner. The deflection surface 14 will thus direct the hot air stream 6 towards the laundry to be dried.

In the embodiment shown in FIG. 1-3, two temperature sensors 4 are arranged in the deflection surface 14 of the deflection means 3.

FIG. 1*b* shows that the temperature sensors 4 in the deflection surface 14 of the deflection means 3 are implemented such that they project into a core area 15 of the hot air stream 6. As can be seen in FIG. 1*b*, the hot air stream 6 has a core area 15, which is surrounded by a boundary area 16. The temperature in the boundary area 16 of the hot air stream 6 is lower than the temperature in the core area 15, since the boundary area 16 is cooled by the ambient air and the support element 2, and since said boundary area 16, which does not flow through but only past the heating elements 5, is heated to a lesser extent by said heating elements 5. It follows that the maximum temperature of the hot air stream and an excessive heating of the heating elements 5 can be sensed more precisely on the basis of the temperature of the core area 15 than on the basis of the temperature of the boundary area 16. The temperature sensors 4 are therefore arranged such that they detect or monitor the temperature of the hot air stream 6 in its core area 15. Due to this improved temperature detection, a precise temperature control of the hot air stream 6 is possible, said precise temperature control being particularly important when delicate clothes are to be dried.

As can be seen in FIG. 1*a*, the two temperature sensors 4 are arranged downstream of the heating element halves which are located on the supply side 12. Metal components, which may fall into the heating assembly 1 when the tumble dryer is in operation, may cause a short circuit between the heating coils 11 of the heating elements 5. The short circuit will reduce the effective length of the heating coils 11, through which electric energy flows and heats said coils when the tumble dryer is in operation, and also the electric resistance of the heating elements 5. Then, the heating elements 5 will only heat between the supply side 12 and the short-circuit location, but there more strongly than is admissible, because the amount of energy introduced remains the same. The temperature sensors 4 are, however, arranged downstream of the heating elements 5 in an area of the hot air stream 6 which is located closer to the supply side 12 of the heating elements 5. The inadmissible heating of the heating elements 5 caused by an excessively high temperature of the hot air stream 6 will therefore be detected within a particularly short period of time. The heating elements 5 can be switched off in time before the back of the tumble dryer or the laundry in the drum will be heated to inadmissibly high temperatures.

The exemplary heating assembly 1 according to the present invention shown in FIG. 1-3 is in particular implemented such that at least one of the temperature sensors 4 is arranged at a position, which is substantially located on a streakline extending on the supply side 12 of the heating elements 5. The streakline is here the locus curve of all particles, which pass the heating elements on the supply side in the course of time. In the case of a short circuit of the heating elements, the temperature of these particles will increase, said temperature being supervised by the temperature sensors. The temperature sensors are arranged in an area, which is located in the projection of the area on the supply side of the heating elements, said projection lying in the passing direction.

The temperature sensors 4 are arranged in openings (not shown) in the deflection surface 14 of the deflection means 3. The temperature sensors 4 are connected to the deflection means 3 by a mechanically releasable connection or by a permanent connection, e.g. by welding spots 17. Alternatively, the temperature sensors 4 may also be connected to the deflection means 3 by rivets, by means of an adhesive, by clinching or by a repeatedly releasable screw connection.

The deflection means 3 is attached to the support element 2. In the embodiment shown in FIG. 1-3, the support element 2 and the deflection means 3 are formed integrally as a deep-drawn metal sheet. Thus, the support element 2 and the deflection means 3 can be produced in one production step, whereby the total number of individual parts and the production costs of the heating assembly 1 is reduced.

The edge of the support element 2 has arranged thereon a sealing 18 by means of which the heating assembly 1 can be attached to a flow passage of a tumble dryer in a gas-tight manner. Furthermore, the support element 2 has provided therein a sealed opening 19 through which the connecting lines 10 of the heating elements 5 extend through the support element 2 in a gas-tight manner. The sealing 18 and the sealed opening 19 guarantee that an escape of part of the hot air stream 6 from the flow passage of the tumble dryer will be prevented.

As can be seen in FIG. 2, a recess 20, which is defined by the deflection surface 14, is formed on the heating assembly side facing away from the hot air stream. The temperature sensor parts projecting rearwards beyond the deflection surface 14 are located in said recess 20. The vault of the said recess 20 extends into the flow passage 29. The heating assembly 1 is implemented such that, in a cross-section transversely to the back of the tumble dryer, it has substantially planar outer contours on the side facing away from the hot air stream 6. This will minimize the thickness D of the heating assembly 1, a circumstance which will be of particular advantage when the heating assembly 1 is installed in the tumble dryer, since in many cases only little installation space will be available for the heating assembly 1 in the tumble dryer. The temperature sensors 4 are implemented such that, when the rear wall 27 of the tumble dryer 26 is open, they are accessible from outside, at least from their back.

The temperature sensors 4 used in the embodiment shown in FIG. 1-3 are implemented as thermostats. Thermostats are small switching units used for executing temperature-dependent switching of an electric signal. In the heating assembly 1 according to FIG. 1-3, the thermostats 4 switch off the heating elements 5 as soon as a predetermined temperature limit is exceeded. For this purpose, the thermostats 4 may comprise e.g. a bimetal element by means of which the flow of energy to the heating elements 5 is switched in a temperature-dependent manner. Control lines leading to the control unit of the tumble dryer can therefore be dispensed with, since the heating assembly 1 supervises the temperature of the heating elements 5 independently and switches off independently when the temperature limit is exceeded.

In order to make connection of the thermostats 4 as easy as possible, said thermostats are provided with two standardized connection contacts (not shown). The connecting lines 10 of the heating elements 5 are attached to the connection contacts by means of plug elements 21. At the second connection contact (not shown), each thermostat 4 is connected via an additional connecting line 10' to a standardized connector 22.

By means of the connector 22, the heating assembly 1 is connected to an energy source in the assembled condition. The back of the connector 22 is provided with a locking means 23. The connector 22 is attached to a cranked flange portion 24 of the support element 2 with the aid of said locking means 23. For supporting the connector 22 in an insertion direction S, in which a mating plug is inserted in said connector 22 during the assembly of the tumble dryer, the cranked flange portion 24 of the support element 2 is provided with reinforcing means 25. As can be seen in FIG. 3, the plug-and-socket connector 22 can be arranged outside of the flow passage of the tumble dryer due to the cranked flange portion 24.

Figure 4:
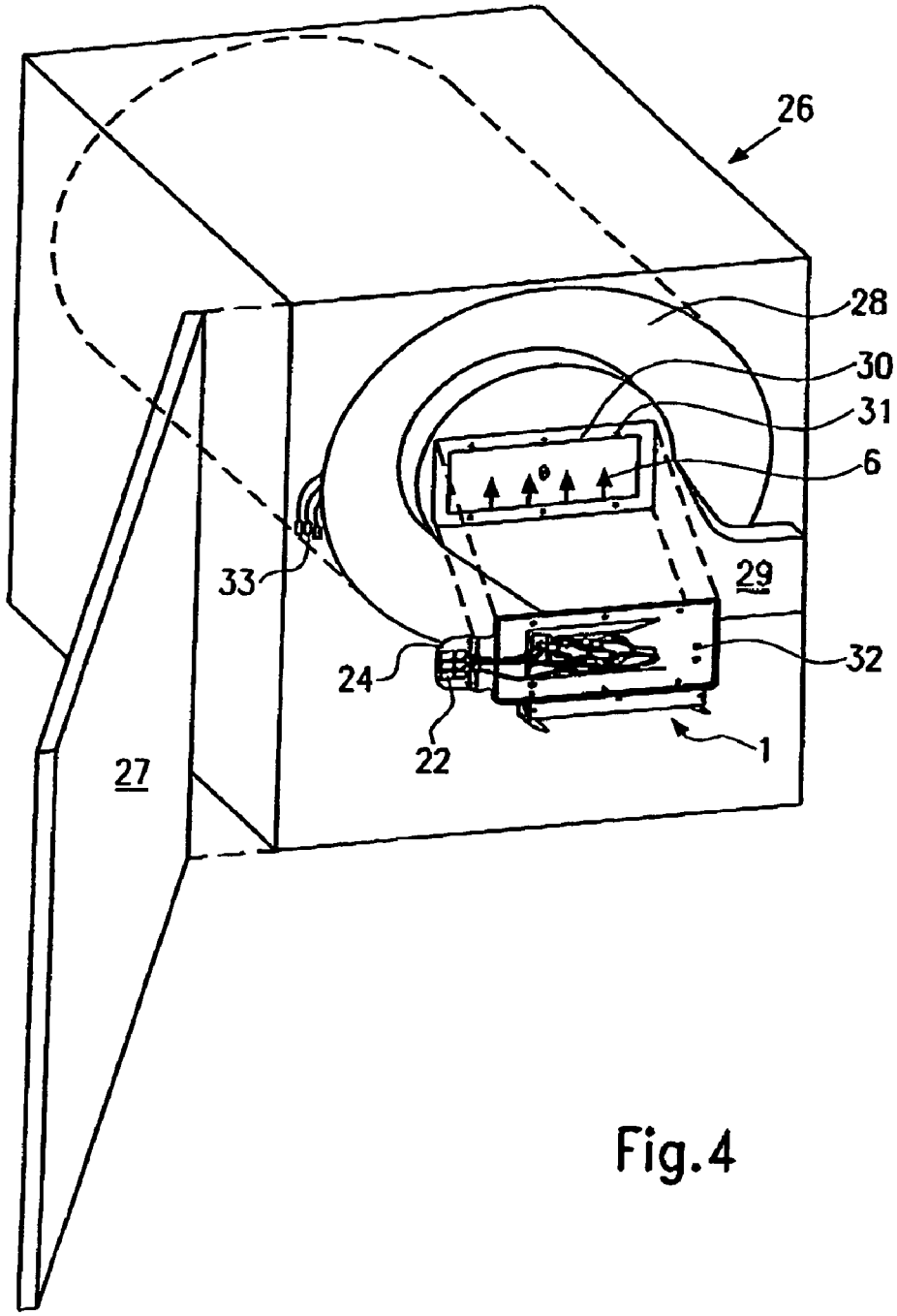
FIG. 4 shows a schematic perspective rear view of a tumble dryer according to the present invention.

FIG. 4 shows the heating assembly 1 of FIG. 1-3, installed in a tumble dryer 26. For the sake of clarity, the tumble dryer 26 is shown without a cover and with an open rear wall 27.

The tumble dryer 26 comprises a drum 28 containing wet laundry when the tumble dryer is in operation. The hot air stream 6 is conducted by an air supply means (not shown) through a flow passage 29 into the drum 28 for drying the wet laundry. The flow passage 29 has an opening 30 having inserted therein the heating assembly 1. Said heating assembly 1 heats the hot air stream 6 in the flow passage 29. The opening 30 of the flow passage 29 has arranged thereon detent devices 31 which are adapted to be brought into locking engagement with mating detent devices 32 provided on the heating assembly 1. This allows the heating assembly 1 to be mounted on the flow passage 29 in a repeatedly removable and timesaving manner. Alternatively, the detent devices 31 and the mating detent devices 32 can also establish a permanent connection or they can be replaced by screw or rivet connections.

When, during assembly of the tumble dryer, the preassembled heating assembly 1 has been installed in the flow passage 29, a mating plug 33 will be attached to the connector 22 so as to connect the heating assembly 1 to a source of energy (not shown). Since the flange portion 24 of the heating assembly 1 is cranked, the connector 22 is arranged in the free installation space beside the flow passage 29 in an advantageous manner. In the installed condition, the heating assembly 1 defines a portion of the flow passage 29, and this allows mounting of said heating assembly 1 in a particular simple manner and within a particularly short period of time.

Due to the particularly flat structural design of the heating assembly 1 and due to the fact that the heating assembly 1 is installed in the flow passage 29, a prescribed distance between all the interior parts of the tumble dryer 26 and the rear wall 27 is observed. This will guarantee that the rear wall 27 of the tumble dryer 26 will not become excessively hot when the tumble dryer is in operation and that it will not pose threat to life and limb of a user.

The invention claimed is:

1. A heating assembly (1) for heating a hot air stream (6) flowing in a flow passage (29) of a tumble dryer (26), said heating assembly (1) being configured for installation in said flow passage (29) and comprising at least one heating element (5) and at least one temperature sensor (4), characterized in that the heating element (5) is arranged such that the hot air stream (6) can flow around it in a passing direction (D), and in that the at least one temperature sensor (4), by means of which the temperature of the hot air stream (6) can be detected, is arranged such that it projects into a core area (15) of the hot air stream (6).

2. A heating assembly (1) according to claim 1, characterized in that a deflection surface (14), which projects into the hot air stream (6) and deflects said hot air stream (6) from a passing direction (D) to a discharge direction (A), is oriented at an angle ( ) relative to the passing direction (D) which is smaller than the angle ( ) defined between the passing direction (D) and the discharge direction (A).

3. A heating assembly (1) according to claim 2, characterized in that the deflection surface (14) projects into the core area (15) of the hot air stream (6).

4. A heating assembly (1) according to claim 2, characterized in that at least one temperature sensor (4) is arranged on the deflection surface (14).

5. A heating assembly (1) according to claim 2, characterized in that the angle ($\alpha$) defined between the deflection surface (14) and the passing direction (D) is essentially half the angle ( ) defined between the passing direction (D) and the discharge direction (A).

6. A heating assembly (1) according to claim 1, characterized in that the at least one temperature sensor (4) is implemented as a thermostat by means of which the supply of energy to the at least one heating element (5) can be controlled in a temperature-dependent manner.

7. A heating assembly (1) according to claim 1, characterized in that the at least one temperature sensor (4) is accommodated in a recess (20) on the side facing away from the hot air stream (6).

8. A heating assembly (1) according to claim 7, characterized in that the at least one temperature sensor (4) is arranged in said recess (20) such that, when the rear wall (27) of the tumble dryer (26) is open, it is accessible from outside, at least from its back.

9. A heating assembly (1) according to claim 7, characterized in that the recess (20) is implemented to vault into the flow passage (29) in the installed condition.

10. A heating assembly (1) according to claim 7, characterized in that the recess (20) is defined by the deflection surface (14).

11. A heating assembly (1) according to claim 1, characterized in that, in a cross-section transversely to the rear wall (27) of the tumble dryer (26), the heating assembly (1) has substantially planar outer contours on the side facing away from the hot air stream (6).

12. A heating assembly (1) according to claim 1, characterized in that the heating assembly (1) is provided with at least one flow guide surface (9) on the flow-in side, said at least one flow guide surface (9) being oriented in the flow-in direction (E) on the flow-in side and in the passing direction (D) on the passing side.

13. A heating assembly (1) according to claim 1, characterized in that connector (22), which is adapted to be connected to a source of energy, is provided on a cranked flange portion (24) of the support element (2), said cranked flange portion (24) being adapted to be arranged outside of the flow passage (29).

14. A heating assembly (10) according to claim 1, characterized in that the heating assembly (1) is provided with a sealing means (18) with the aid of which the heating assembly can be attached to the flow passage (29) of the tumble dryer (26) in a gas-tight manner.

15. A heating assembly (1) according to claim 1, characterized in that the heating assembly (1) is provided with at least one sealed opening (19) through which at least one connecting line (10) of the at least one heating element (5) extends.

16. A heating assembly (1) according to claim 1, characterized in that the heating assembly (1) is implemented such that it can be installed in the flow passage (29) in the form of a preassembled one-piece component.

17. A heating assembly (1) according to claim 1, wherein, when the heating assembly is in operation, electric energy is conducted on a supply side (12) through at least two heating elements (5), which are arranged in parallel and connected in series, characterized in that the at least one temperature sensor (4) is arranged downstream of the heating elements (5) in the area of the hot air stream (6) that is located closer to the supply side (12) of said heating elements (5).

18. A heating assembly (1) according to claim 17, characterized in that the at least one temperature sensor (4) is arranged downstream of the heating element halves located on the supply side (12).

19. A heating assembly (1) according to claim 17, characterized in that the at least one temperature sensor (4) is arranged at a position which is substantially located on a streakline extending on the supply line (12) of the heating elements (5).

20. A tumble dryer (26) used for drying wet laundry in a hot air stream (6), said tumble dryer (26) being implemented such that it comprises an air supply means and a flow passage (29) through which the hot air stream (6) can flow, characterized in that the tumble dryer (26) comprises a heating assembly (1) according to claim 1.

21. A tumble dryer (26) according to claim 20, characterized in that the heating assembly (1) defines, at least sectionwise, the flow passage (29) of the tumble dryer (26).

22. A tumble dryer (26) according to claim 20, characterized in that the heating assembly (1) is releasably or permanently mounted on the flow passage (29) by means of at least one detent device (31).

23. A method of assembling a tumble dryer (26) with the aid of which a hot air stream (6) used for warming up wet laundry can be heated, when the tumble dryer is in operation, said method comprising the following steps:

preassembling a deflection means (3) having at least one deflection surface (14), at least one heating element (5) and at least one temperature sensor (4) so as to obtain a heating assembly (1), installing the heating assembly (1) in a flow passage (29) through which the hot air stream (6) flows when the tumble dryer (26) is in operation, so that the temperature sensor (4) projects into a core area (15) of the hot air stream (6).

24. A method of assembling a tumble dryer (26) with the aid of which a hot air stream (6) used for warming up wet laundry can be heated, when the tumble dryer is in operation, said method comprising the following steps:

preassembling a deflection means (3) having at least one deflection surface (14), at least one heating element (5) and at least one temperature sensor (4) so as to obtain a heating assembly (1), thereby arranging the temperature sensor (4) on the deflection surface (14), installing the heating assembly (1) in a flow passage (29) through which the hot air stream (6) flows when the tumble dryer (26) is in operation.

* * * * *